US008920213B2

(12) United States Patent
Liu

(10) Patent No.: US 8,920,213 B2
(45) Date of Patent: Dec. 30, 2014

(54) ABRASIVE JET SYSTEMS, INCLUDING ABRASIVE JET SYSTEMS UTILIZING FLUID REPELLING MATERIALS, AND ASSOCIATED METHODS

(75) Inventor: Peter H. -T. Liu, Bellevue, WA (US)

(73) Assignee: OMAX Corporation, Kent, WA (US)

( * ) Notice: Subject to any disclaimer, the term of this patent is extended or adjusted under 35 U.S.C. 154(b) by 529 days.

(21) Appl. No.: 13/038,779

(22) Filed: Mar. 2, 2011

(65) Prior Publication Data

US 2012/0156969 A1 Jun. 21, 2012

Related U.S. Application Data

(60) Provisional application No. 61/310,658, filed on Mar. 4, 2010, provisional application No. 61/432,580, filed on Jan. 13, 2011.

(51) Int. Cl.
*B24C 7/00* (2006.01)
*B24C 5/02* (2006.01)

(52) U.S. Cl.
CPC .. *B24C 7/003* (2013.01); *B24C 5/02* (2013.01)
USPC ..... 451/40; 451/99

(58) Field of Classification Search
USPC ..... 451/38, 60, 75, 99, 446, 40, 39
See application file for complete search history.

(56) References Cited

U.S. PATENT DOCUMENTS

| | | | |
|---|---|---|---|
| 3,834,082 | A | 9/1974 | Grudzinski |
| 4,878,320 | A | 11/1989 | Woodson |
| 5,352,254 | A | 10/1994 | Celikkaya |
| 5,468,066 | A | 11/1995 | Hammonds |
| 5,643,058 | A | 7/1997 | Erichsen et al. |
| 5,771,873 | A | 6/1998 | Potter et al. |
| 6,098,677 | A | 8/2000 | Wegman et al. |
| 6,136,386 | A | 10/2000 | Nakahigashi et al. |
| 6,227,768 | B1 | 5/2001 | Higuchi et al. |
| 6,548,173 | B2 | 4/2003 | Erdemir et al. |
| 7,094,135 | B2 | 8/2006 | Chisum et al. |
| 7,465,215 | B2 | 12/2008 | Shimizu et al. |
| 8,342,912 | B2 | 1/2013 | Funatsu et al. |
| 2005/0017091 | A1 | 1/2005 | Olsen et al. |
| 2012/0021676 | A1 | 1/2012 | Schubert et al. |
| 2012/0196516 | A1 | 8/2012 | Funatsu et al. |
| 2012/0252325 | A1 | 10/2012 | Schubert et al. |
| 2012/0252326 | A1 | 10/2012 | Schubert et al. |
| 2013/0005225 | A1 | 1/2013 | Russo |

OTHER PUBLICATIONS

International Search Report and Written Opinion for International Patent Application No. PCT/US2011/026821, Applicant: Omax Corporation, mailed May 2, 2011, 11 pages.
U.S. Appl. No. 13/165,009, filed Jun. 21, 2011, Scubert et al.
U.S. Appl. No. 14/209,949, filed Mar. 13, 2014, Liu et al.
U.S. Appl. No. 14/210,017, filed Mar. 13, 2014, Liu et al.
PCT International Preliminary Report on Patentability from the International Bureau for PCT/US2011/026821, mailed Sep. 13, 2012, Applicant: Omax Corporation, 9 pages.

*Primary Examiner* — Robert Rose
(74) *Attorney, Agent, or Firm* — Perkins Coie LLP

(57) ABSTRACT

Various embodiments of abrasive jet systems are described herein. In one embodiment, an abrasive jet system includes an abrasive container and a nozzle assembly. The nozzle assembly has a mixing region or cavity and an abrasive inlet. The abrasive jet system can also include an abrasive supply conduit that is operably coupleable between the abrasive container and the abrasive inlet. The abrasive supply conduit includes a first interior surface portion configured to be positioned proximate to the abrasive inlet and a second interior surface portion, different from the first interior surface portion, configured to be spaced apart from the abrasive inlet. In one aspect of this embodiment, the first interior surface portion has a greater ability to repel fluid (e.g., water) than the second interior surface portion, thereby reducing a tendency of the abrasives to clog the abrasive supply conduit.

29 Claims, 7 Drawing Sheets

ABRASIVE JET SYSTEMS, INCLUDING ABRASIVE JET SYSTEMS UTILIZING FLUID REPELLING MATERIALS, AND ASSOCIATED METHODS

CROSS-REFERENCE TO RELATED APPLICATIONS

This application claims the benefit of U.S. Provisional Patent Application No. 61/310,658, entitled "ABRASIVE JET SYSTEMS, INCLUDING ABRASIVE JET SYSTEMS UTILIZING HYDROPHOBIC MATERIALS, AND ASSOCIATED METHODS" filed Mar. 4, 2010, and U.S. Provisional Patent Application No. 61/432,580, entitled "ABRASIVE JET SYSTEMS, INCLUDING ABRASIVE JET SYSTEMS UTILIZING HYDROPHOBIC MATERIALS, AND ASSOCIATED METHODS" filed Jan. 13, 2011, both of which are incorporated herein by reference in their entirety.

TECHNICAL FIELD

This application describes abrasive jet systems, such as abrasive jet systems utilizing fluid repelling materials, and methods associated with abrasive jet systems.

BACKGROUND

Abrasive jet systems that produce high-velocity, abrasive-laden fluid jets for accurately and precisely cutting various materials are well known. Abrasive jet systems typically function by pressurizing water (or another suitable fluid) to a very high pressure (e.g., up to 90,000 pounds per square inch (psi) or more) by, for example, a high-pressure pump connected to an abrasive jet cutting head. The pressurized water is forced through an orifice at a very high speed (e.g., up to 2500 feet per second or more). The orifice forms the water jet. The orifice is typically a hard jewel (e.g., a synthetic sapphire, ruby, or diamond) held in an orifice mount. The resulting water jet is discharged from the orifice at a velocity that approaches or exceeds the speed of sound. The liquid most frequently used to form the jet is water, and the high-velocity jet may be referred to as a "water jet," or a "waterjet."

Abrasives can be added to the water jet to improve the cutting power of the water jet. Adding abrasives to the water jet produces an abrasive-laden water jet referred to as an "abrasive water jet" or an "abrasive jet." To produce an abrasive jet, the water jet passes through a mixing region in a nozzle. The abrasive, which can be under atmospheric (ambient) pressure or pressurized in an external hopper, is conveyed through a meeting orifice via a gravity feed or a pressurized feed from the hopper through an attached abrasive supply conduit to the nozzle. A quantity of abrasive regulated by the meeting orifice is entrained into the water jet in the mixing region. Typical abrasives include garnet and aluminum oxide. Generally, the maximum diameter of individual abrasives should be no greater than approximately one third of the internal diameter of the abrasive supply conduit to prevent bridging of two particles, which can lead to clogging of the abrasive supply conduit. The abrasives can have grit mesh sizes ranging between approximately #36 and approximately #320, as well as other smaller and larger sizes.

The resulting abrasive-laden water jet is then discharged against a workpiece through a nozzle tip that is adjacent to the workpiece. The abrasive jet can be used to cut a wide variety of materials. For example, the abrasive jet can be used to cut hard materials (such as tool steel, aluminum, cast-iron armor plate, certain ceramics and bullet-proof glass) as well as soft materials (such as lead). A typical technique for cutting by an abrasive jet is to mount a workpiece to be cut in a suitable jig, or other means for securing the workpiece into position. The abrasive jet can be directed onto the workpiece to accomplish the desired cutting, generally under computer or robotic control. It is generally not necessary to keep the workpiece stationary and to manipulate the abrasive jet cutting tool. The workpiece can be manipulated under a stationary cutting jet, or both the abrasive jet and the workpiece can be manipulated to facilitate cutting.

DETAILED DESCRIPTION

Overview

Figure 1:
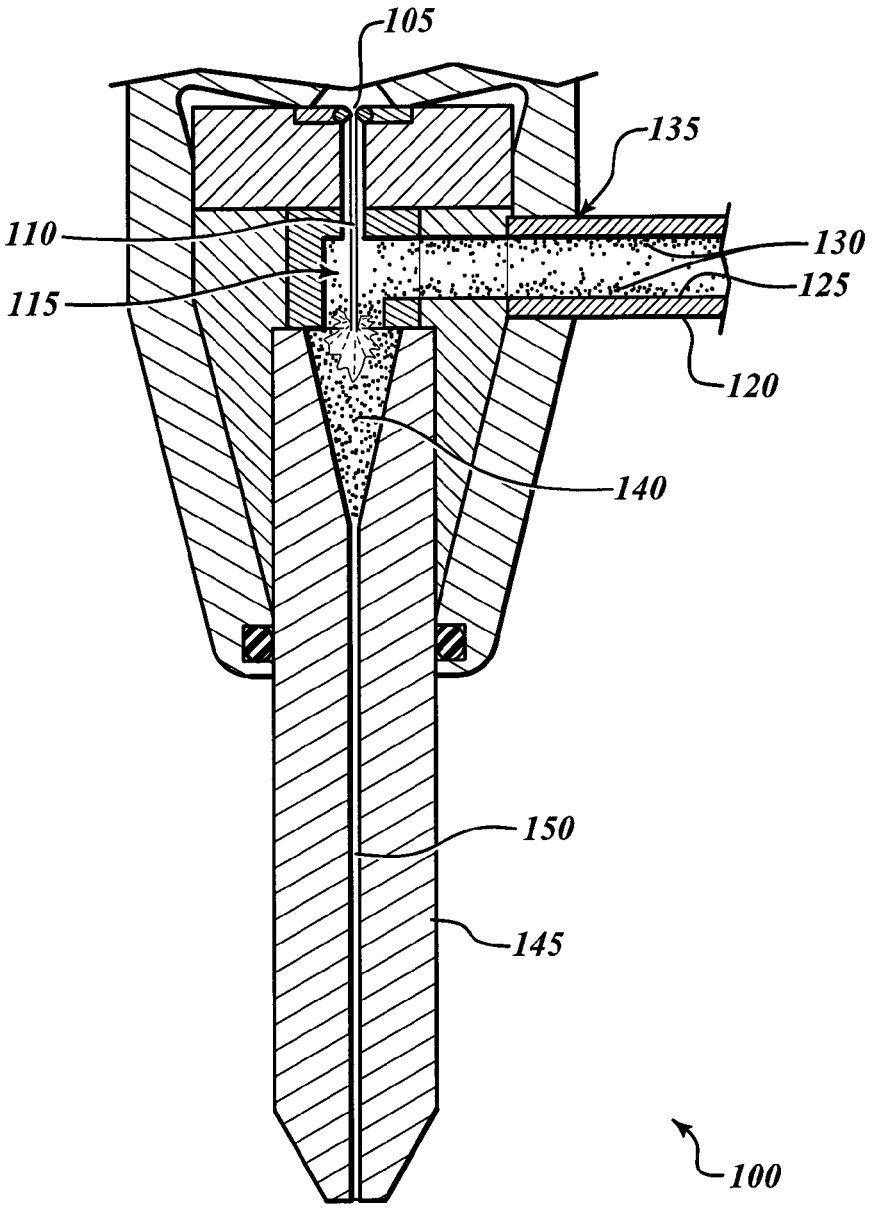
FIG. 1 is a cross-sectional side view of a portion of an abrasive jet system nozzle assembly configured in accordance with an embodiment of the disclosure.

This application describes various embodiments of abrasive jet systems for cutting materials, including abrasive jet systems utilizing hydrophobic materials or other fluid or liquid phobic materials. For example, abrasive jet systems as disclosed herein can be used with a variety of suitable working fluids or liquids to form the fluid jet. More specifically, abrasive jet systems configured in accordance with embodiments of the present disclosure can include working fluids such as water, aqueous solutions, paraffins, oils (e.g., mineral oils, vegetable oil, palm oil, etc.), glycol, liquid nitrogen, and other suitable abrasive jet cutting fluids. As such, the term "water jet" or "waterjet" as used herein may refer to a cutting jet formed by any working fluid associated with the corresponding abrasive jet system, and is not limited exclusively to water or aqueous solutions. In addition, although several embodiments of the present disclosure are described below with reference to water, other suitable working fluids can be used with any of the embodiments described herein. Moreover, the term "hydrophobic" as used herein to describe components and/or characteristics of the present disclosure is intended to mean the tendency to repel the working fluid, not to be wetted by the working fluid, not to absorb the working fluid, not to be attracted to the working fluid, and/or to otherwise lack an affinity for the working fluid. As such, the term hydrophobic as used herein is intended to refer to the working fluid of the abrasive jet system, and is not limited to refer exclusively to water or aqueous solutions as the working fluid of the abrasive jet system. Certain details are set forth in the following description and in FIGS. 1-7 to provide a thorough understanding of various embodiments of the technology. Other details describing well-known aspects of abrasive jet systems, however, are not set forth in the following disclosure so as to avoid unnecessarily obscuring the description of the various embodiments.

Many of the details, dimensions, angles and other features shown in the Figures are merely illustrative of particular embodiments. Accordingly, other embodiments can have other details, dimensions, angles and features. In addition, further embodiments can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1.

In one embodiment, an abrasive jet system includes an abrasive container and a nozzle assembly. The nozzle assembly has a mixing region or cavity downstream of a fluid inlet aperture and an abrasive inlet aperture. The abrasive jet system can also include an abrasive supply conduit that is operably coupleable between the abrasive container and the abrasive inlet aperture. The abrasive supply conduit includes a first interior surface portion configured to be positioned proximate to the abrasive inlet aperture and a second interior surface portion, different from the first interior surface portion, configured to be spaced apart from the abrasive inlet aperture. In one aspect of this embodiment, the first interior surface portion has a greater ability to repel fluid (e.g., water) than the second interior surface portion, thereby reducing a tendency of the abrasives to clog the abrasive supply conduit.

In another embodiment, an abrasive jet system includes a nozzle assembly having a mixing region or cavity downstream of a fluid inlet aperture, and an abrasive inlet aperture proximate to the mixing cavity. The abrasive jet system of this embodiment also includes an abrasive container containing abrasives that are not wettable, or at least generally not wettable, by a working fluid such as water, and an abrasive supply conduit operably coupleable between the abrasive container and the abrasive inlet aperture.

In a further embodiment, a method of manufacturing an abrasive jet system includes forming an abrasive supply conduit. The abrasive supply conduit can be formed by operably coupling a first tube portion to a second tube portion. The first tube portion includes a hydrophobic interior surface portion, and the second tube portion includes a non-hydrophobic interior surface portion. In some applications however, the second tube portion can also include a hydrophobic interior surface portion. Moreover, the first and second tube portions can be integral portions of the abrasive supply conduit or separate connected portions of the abrasive supply conduit. The method can further include operably coupling the second tube portion of the abrasive supply conduit to an abrasive source and operably coupling the first tube portion of the abrasive supply conduit to an abrasive inlet port on a abrasive jet nozzle assembly, such that the first tube portion is proximate to the abrasive inlet port.

Abrasive Jet Systems and Associated Methods

Abrasive jet systems, such as abrasive waterjet systems or abrasive slurry jet systems, may be used for micromachining workpieces. In general, micromachining refers to machining features of less than 500 microns (0.02 inch) in size. Abrasive jet systems that may be used for micromachining typically include a nozzle assembly having a mixing tube (alternatively referred to as a discharge tube) with a small inside diameter, as the inside diameter is proportional to a micromachining kerf width.

FIG. 1 is a cross-sectional side view of a portion of an abrasive jet nozzle assembly 100 configured in accordance with an embodiment of the disclosure. In the illustrated embodiment, the nozzle assembly 100 includes a mixing tube 145 having an axial passage 150. In some embodiments, the axial passage 150 can have an inside diameter of at least approximately 0.015 inch (0.38 mm). In other embodiments, however, the inside diameter of the axial passage 150 can be greater than or less than approximately 0.015 inch. The nozzle assembly 100 also includes a fluid inlet orifice or aperture 105. In certain embodiments, the orifice can have an inside diameter of at least approximately 0.007 inch (0.18 mm). In other embodiments, however the inside diameter of the orifice 105 can be less than or greater than 0.007 inch. Pressurized water (or other suitable working fluids) passes through the orifice 105, forming a fluid or water jet 110. The nozzle assembly 100 also includes an abrasive supply conduit 120 attached to an abrasive inlet port 135. The abrasive supply conduit 120 conveys abrasives to a mixing region 115 (alternatively referred to as a mixing cavity 115) via a passage. The abrasives are mixed with the water jet 110 in the mixing region 115, thereby forming an abrasive jet. The abrasive jet is conveyed through the axial passage 150 of the mixing tube before being expelled from the mixing tube 145. In certain embodiments, the abrasives can include garnet, aluminum oxide, baking soda, sugars, salts, ice particles, or other suitable abrasive particles.

In some cases, an accumulation of abrasives (as indicated by reference number 130) may form in one or more portions of the abrasive supply conduit 120 proximate to the abrasive inlet port 135. The abrasives accumulation 130 may thereby clog or otherwise prevent a sufficient quantity of abrasives from entering the mixing region 115 and mixing with the water jet 110, potentially leading to poor cutting performance.

Without wishing to be bound by any particular theory, it is believed that the abrasives accumulation 130 may be caused at least partly by the small inside diameter of the axial passage 150 of the mixing tube 145. For example, when the abrasive jet system is turned off after an operating cycle, water may fill the axial passage 150 due to capillary action, leaving a column of water trapped in the axial passage 150 and causing a mixture of water and abrasives to fill an inlet region of the mixing tube (as indicated by reference number 140). When the abrasive jet system is turned back on, the water jet 110 impacts an upper surface of the water and abrasives mixture 140. The impact can cause a splash that includes water and abrasives. A portion of the splash may pass the abrasive inlet port 135 and land on and adhere to the interior surface 125 of the abrasive supply conduit 120, thereby forming the abrasives accumulation 130. After a certain number of on and off operating cycles of the abrasive jet system, the abrasives accumulation 130 may accumulate to the point that the vacuum induced by water jet 110 is insufficient to remove the abrasives accumulation 130 from the interior surface 125 of the abrasive supply conduit 120. This abrasive accumulation 130 may also prevent pressurized, vacuum, or forced feeding of the abrasives. The abrasives accumulation 130 may thus prevent a sufficient quantity of abrasives from being mixed with the water jet 110 or otherwise adversely affect the function of the nozzle assembly 100. An insufficient quantity of abrasives may adversely affect the ability of the abrasive jet system to cut a workpiece according to a desired quality. Accordingly, it would be useful to wholly or partially reduce the abrasives accumulation 130 on the interior surface 125 of the abrasive supply conduit 120, both to facilitate nozzle operations and to maintain a desired cut quality.

Figure 2:
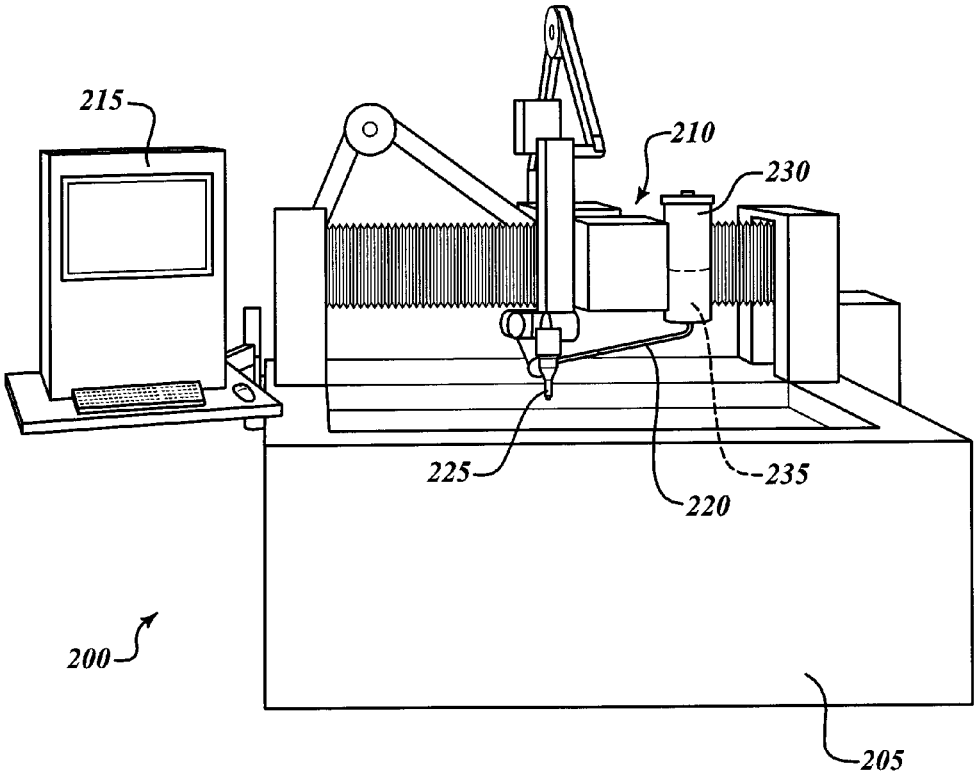
FIG. 2 is an isometric view of an abrasive jet system configured in accordance with an embodiment of the disclosure.

FIG. 2 is an isometric view of an abrasive jet system 200 configured in accordance with an embodiment of the disclosure. As described in greater detail herein, in one aspect of this embodiment, the abrasive jet system 200 wholly or partially reduces the aforementioned abrasives accumulation 130. The abrasive jet system 200 includes a base 205 and a mechanism 210 for moving a nozzle assembly 225 in both the X and Y directions. The abrasive jet system 200 may also include pressurized working fluid or water source, such as a pump (not shown in FIG. 2) that conveys highly pressurized water (e.g., water at a high pressure, such as about 15,000 psi or less to about 60,000 psi or more) to the nozzle assembly 225. The abrasive jet system 200 also includes an abrasive container 230 and an abrasive supply conduit 220 that conveys abrasives 235 from the abrasive container 230 to the nozzle assembly 225. In some embodiments, the abrasive jet system 200 can also include pressurized or vacuum conveyance of abrasives 235 to the nozzle assembly 225. In the illustrated embodiment, the abrasive jet system 200 can also include a controller 215 that an operator may use to program or otherwise control the abrasive jet system 200.

Figure 3:
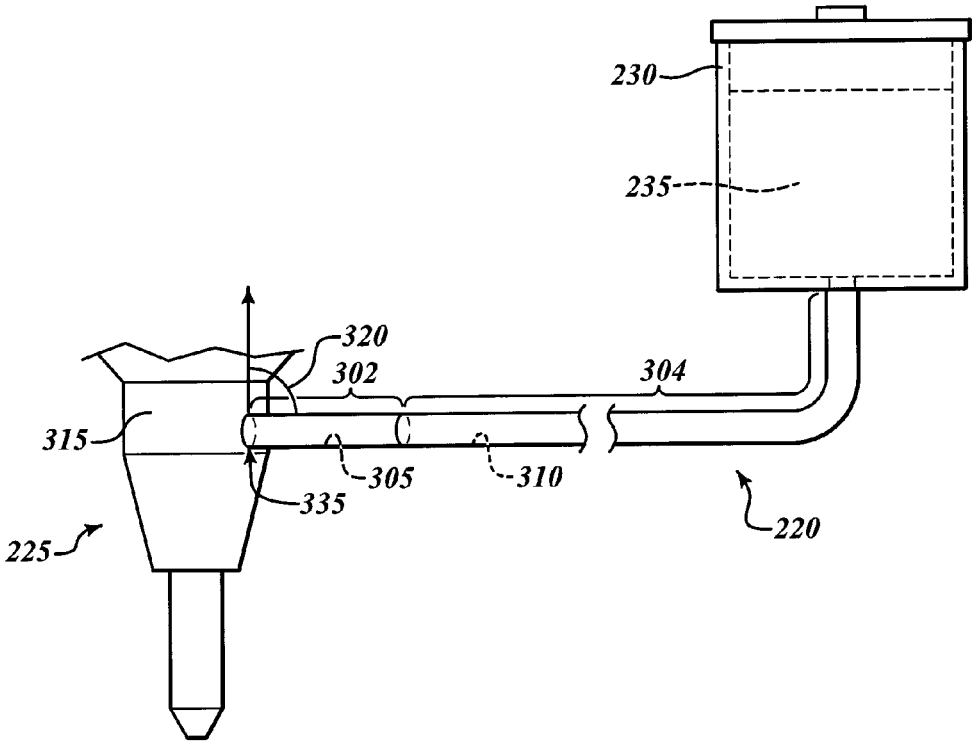
FIG. 3 is an enlarged side view of a portion of the abrasive jet system of FIG. 2.

FIG. 3 is an enlarged view of a portion of the abrasive jet system of FIG. 2, illustrating the nozzle assembly 225, the abrasive container 230 and the abrasive supply conduit 220 in more detail. The nozzle assembly 225 has an abrasive inlet port 335 (alternatively referred to as an abrasive feed port or a feed port) that extends through an external surface 315 thereof. The abrasive supply conduit 220 includes two conduit portions operably coupled together. A first conduit portion 302 is operably coupled to the abrasive inlet port 335. A second conduit portion 304, different from the first conduit portion 302, is operably coupled to the abrasive container 230. The first 302 and second 304 conduit portions of the abrasive supply conduit 220 are operably coupled together. In some embodiments, the two conduit portions of the abrasive supply conduit 220 form a tube having an outside diameter of about 0.25 inch (6.4 mm) and an inside diameter of about 0.125 inch (3.2 mm), and the length of the tube may vary. In such embodiments, the first 302 and second 304 conduit portions can be coupled together to form a generally seamless transition between the two conduit portions. In some embodiments, the first conduit portion 302 can have a length of from about 2 inches (50 mm) to about 4 inches (100 mm), e.g., about 3 inches.

The abrasive inlet port 335 has an approximately 90-degree orientation (as indicated by reference number 320) to the external surface 315 of the nozzle assembly 225. In some embodiments, the abrasive feed port 335 can have a less than 90 degree orientation (e.g., a 45-degree orientation) to the external surface 315 of the nozzle assembly 225. In such embodiments, the abrasive supply conduit 220 may be sufficiently tensioned between the abrasive container 235 and the nozzle assembly 225 to partially or wholly eliminate any sagging of the abrasive supply conduit 220. In such embodiments, gravitational forces may assist in reducing the accumulation of abrasives in the abrasive supply conduit 220. In other embodiments, however, pressure, vacuum, or mechanical components can be used to assist the flow of abrasives through the supply conduit 220.

In one aspect of this embodiment, the first abrasive supply portion 302 includes a first interior surface portion 305 that repels or at least partially repels water. For example, the first interior surface portion 305 can include hydrophobic material such as polytetrafluoroethylene (sold by DuPont under the trade name Teflon®) that repels or at least partially repels water. In addition to or as an alternative to including polytetrafluoroethylene, the first interior surface portion 305 may include other hydrophobic materials, such as fluoropolymers, fluorocarbons, and/or other at least generally hydrophobic materials that prevent or at least inhibit water from adhering to the first interior surface portion 305, or otherwise repel or at least partially repel water from the first interior surface portion 305.

Figure 4A:
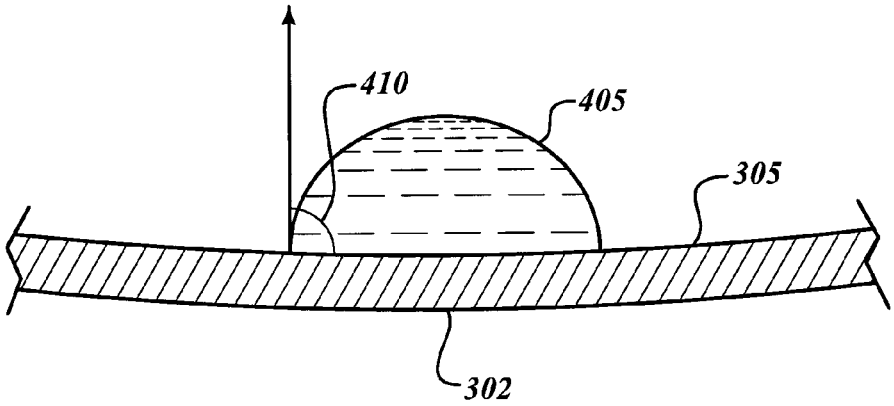
FIGS. 4A and 4B are enlarged cross-sectional views of a portion of an abrasive supply conduit.

Referring to FIG. 4A, a droplet of water 405 positioned on the first interior surface portion 305 forms a contact angle 410 that is approximately 90 degrees. The first interior surface portion 305, being at least generally hydrophobic, prevents or at least inhibits water that is splashed back into the abrasive supply conduit 220 from adhering to the first interior surface portion 305. Any such water that splashes back is swept back into the mixing region 115 of the nozzle assembly 225 by the suction induced by the water jet 110 (see FIG. 1). Because any water positioned on the first interior surface portion 305 is swept away, any abrasives 235 being conveyed from the abrasive container 230 to the mixing region are not wetted by the water and do not detrimentally accumulate on the first interior surface portion 305.

Figure 4B:
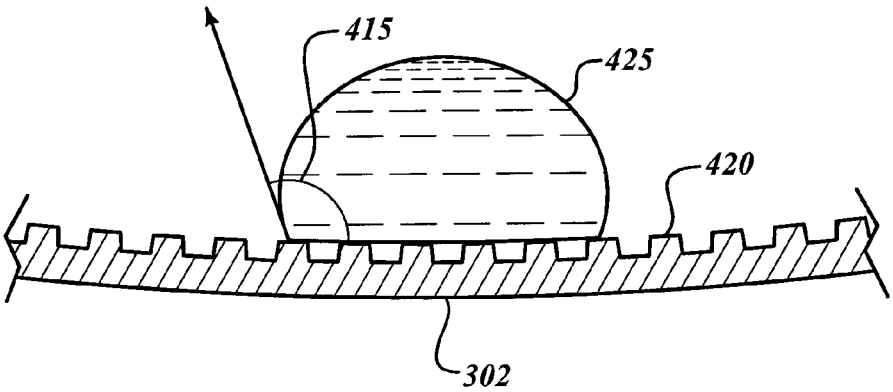

As abrasives 235 flow through the abrasive supply conduit 220, the abrasives 235 may roughen the first interior surface portion 305. The first interior surface portion 305 may then become superhydrophobic. Referring to FIG. 4B, a droplet of water 425 on the superhydrophobic first interior surface portion 420 forms a contact angle 410 that is greater than 90 degrees (e.g., 135 degrees). There can also be a thin film of air between the water droplet and the superhydrophobic first interior surface portion 420.

Returning to FIG. 3, the second conduit portion 304 includes a second interior surface portion 310. In some embodiments, the second interior surface portion 310 is non-hydrophobic. In such embodiments, the second interior surface portion 310 does not prevent water from adhering to the second interior surface portion 310. Because the first interior surface portion 305 is configured to repel water and the second interior surface portion 310 is not configured to repel water, the first interior surface portion 305 and the second interior surface portion 310 have different abilities to repel water. Accordingly, the first interior surface portion 305 has a greater ability to repel water than the second interior surface portion 310.

One reason for the second interior surface portion 310 to be non-hydrophobic is that using a hydrophobic material for the entire length of the abrasive supply conduit 220 may allow for the buildup of static electricity. The buildup of static electricity may prevent abrasives 235 from flowing uniformly and consistently through the abrasive supply conduit 220. Using hydrophobic material in the first interior surface portion 305 and non-hydrophobic material in the second interior surface portion 310 can wholly or partially alleviate the buildup of static electricity, thus facilitating uniform and consistent flow of abrasives 235 through the abrasive supply conduit 220. In other embodiments, however, each of the first interior surface portion 302 and the second interior portion 304 can be hydrophobic. In such embodiments, for example, the entire length or a substantial portion of the entire length of the interior surface of the abrasive supply conduit 220 can be hydrophobic. Moreover, the abrasive supply conduit 220 can be grounded to eliminate or at least partially prevent static electricity buildup in the abrasive supply conduit 220. In still further embodiments, the first conduit portion 302 and the second conduit portion 304 can be integral portions of the abrasive supply conduit 220.

In one embodiment, the abrasive container 230 may carry hydrophobic abrasives 235 (for example, garnet or other suitable media) that are not wettable by water or other fluids. For example, the hydrophobic abrasives 235 may include hydrophobic (or superhydrophobic) material on an exterior surface of the hydrophobic abrasives. As another example, the hydrophobic abrasives 235 may be formed entirely of hydrophobic (or superhydrophobic) material. The hydrophobic abrasives 235 can be created by treating the abrasives to include hydrophobic material as a result of a nanotechnology process. As another example, the hydrophobic abrasives 235 can be created by reacting trimethylchlorosilane [$(CH_3)_3SiCl$] at surfaces of silicate-based materials to render the silicate-based materials hydrophobic. As a further example, the hydrophobic abrasives 235 can be created by coating abrasives with hydrophobic or superhydrophobic materials (e.g., hydrophobic materials sold by 3M under the trade name Scotchguard). In other embodiments, other types of hydrophobic and/or partially hydrophobic materials, and/or other hydrophobic treatments can be used without departing from the present disclosure. The hydrophobic abrasives 235 repel or at least partially repel water and stay dry when exposed to or submerged in water or other working fluids.

In certain applications, such as micromachining applications, the nozzle assembly is typically downsized to form an abrasive jet with a relatively fine beam diameter. As noted above, however, the maximum particle diameter of individual abrasives should generally be no greater than approximately one third of the internal diameter of the abrasive supply conduit to avoid the bridging of two abrasive particles thereby leading to clogging of the abrasive supply conduit. As a result, in micromachining applications the size (e.g., diameter) of individual abrasives is typically reduced proportionally to the internal diameter of the abrasive supply conduit. It is known, however, that the ability of fine abrasives (e.g., 220 mesh and finer) to flow through the abrasive supply conduit solely under the force of gravity is poor. Moreover, such fine abrasives also tend to coagulate or clump together and further reduce the ability to flow through the abrasive supply conduit. Coating fine abrasives with hydrophobic materials according to embodiments of the present disclosure helps to at least partially improve the flowability of these fine abrasives. However, coagulation of these hydrophobic abrasives may still occur, thereby leading to clogging of the abrasive supply conduit or in the mixing region. As such, in certain embodiments, anti-coagulation agents can be added into the abrasives before coating the abrasives with hydrophobic materials. Therefore, the coated abrasives would not only be hydrophobic, but also exhibit anti-coagulation properties thereby ensuring that the fine abrasives would be fed smoothly and steadily via gravity through abrasive supply conduits without relying on vacuum assist and water flushing. In certain embodiments, suitable anti-coagulation agents can include, for example, fumed silica.

As such, hydrophobic abrasives 235 neither coagulate nor adhere to the interior surface of the abrasive supply conduit 220 or to a surface of the inlet region of the mixing tube 145 of the nozzle assembly 225. As a result, any splash from the nozzle directed toward the abrasive supply conduit 220 contains both droplets of water or other fluids and the dry hydrophobic abrasives 235. The dry hydrophobic abrasives 235 do not adhere to the first interior surface portion 305 of the abrasive supply conduit 220, and thus can be entrained into the water jet 110 and exit through the mixing tube 145 (see FIG. 1). In some embodiments, very fine hydrophobic abrasives (e.g., 320 mesh and finer) may be used. In such embodiments, the abrasive jet system 200 may also include a device (e.g., a vacuum, pressure source, an agitator, or other suitable mechanical or fluidizing device, not shown in the Figures) that assists with the flow of hydrophobic abrasives 235 from the abrasive container 230 to the nozzle assembly 225.

The hydrophobic abrasives 235 are not wettable, or at least generally not wettable, by water, and therefore do not adhere to the abrasive supply conduit 220. The hydrophobic abrasives 235 thus can be forced back into the mixing region 115 of the nozzle assembly 225 when the water jet 110 passes through the orifice and creates a vacuum effect. During a transition period before the water jet 110 reaches its maximum speed, the hydrophobic abrasives 235 stay dry and do not adhere to the first interior surface portion 305 of the abrasive supply conduit 220. Accordingly, use of hydrophobic abrasives 235 in the abrasive jet system 200 as described herein reduces the clogging in the abrasive supply conduit 220. Such reduction in clogging ensures a sufficient quantity of hydrophobic abrasives 235 are able to be mixed with the water jet 110, thereby ensuring that a workpiece being cut (or otherwise processed) by the abrasive jet system 200 is cut with a desired quality.

The combination of an at least partially hydrophobic supply conduit and hydrophobic abrasives will provide increased reliability of cutting. Moreover, utilizing an abrasive supply conduit 220 to which abrasives do not adhere and/or hydrophobic abrasives in an abrasive jet system may partially or completely remove the need to use vacuum assist devices and/or flushing devices to prevent clogging. A typical vacuum assist device attaches to a nozzle assembly via a port connected to the mixing chamber. The vacuum assist device creates a vacuum that removes residue water and wet abrasives in the mixing region and inlet region of the mixing tube. Flushing devices may also be used to remove wet abrasives that remain in the abrasive supply conduits and the mixing chamber. Using a vacuum assist device and/or a flushing device may have several disadvantages. For example, 1) the vacuum assist and the flushing device may result in a complex and/or bulky nozzle assembly; 2) additional software and/or hardware controls for operating the vacuum assist and the flushing device may be required; 3) additions of the vacuum assist and flushing operation may increase the odds of system malfunction; 4) the increase in the bulkiness of the nozzle assembly may make articulation of the nozzle assembly more difficult; and 5) more abrasives must be used as some abrasives are removed by the vacuum assist and/or flushing device and thus do not contribute to cutting, which may increase overall system cost.

The use of an abrasive supply conduit 220 and/or the use of hydrophobic abrasives 235 in an abrasive jet system as described herein may partially or wholly eliminate the clogging in the abrasive supply conduit 220. Such use may wholly or partially obviate the need for vacuum assist devices and/or flushing devices. Accordingly, such use 1) may provide for a simpler and more compact nozzle assembly; 2) may obviate the need to add additional software and/or hardware; 3) may reduce the odds of system malfunction and/or part rejection; 4) may provide for a more articulable nozzle assembly; and 5) may reduce abrasive waste. In embodiments where vacuum assist devices and/or flushing devices are not used, the nozzle assembly 225 does not have an external aperture, opening, or port to which vacuum assist devices and/or flushing devices may be operably coupled.

Moreover, the use of an abrasive supply conduit 220 and/or the use of hydrophobic abrasives 235 as described herein facilitates micromachining by allowing for use of mixing tubes and orifices with smaller diameters. For example, a nozzle assembly having an orifice with an inside diameter of about 0.0035 inch (0.09 mm) and a mixing tube with an inside diameter of about 0.008 inch (0.25 mm) can be used. In some embodiments, the nozzle assembly can have an orifice with an inside diameter smaller than 0.0035 inch and/or a mixing tube with an inside diameter smaller than 0.008 inch. Accordingly, an abrasive jet system utilizing the abrasive supply conduit 220 and/or hydrophobic abrasives 235 as described herein can provide significant advantages.

In some embodiments, the abrasive jet system may heat the fluid to a temperature sufficient to cause the fluid to change phase after the fluid exits the mixing tube. Such an abrasive jet system may be referred to as a flash vaporizing abrasive jet system, and may use heating techniques described in U.S. Patent Application Publication No. 2008/006049, which is hereby incorporated by reference in its entirety. Such heating can reduce piercing damage to materials such as laminates, composites and/or other brittle materials. Upon exiting the nozzle assembly, the superheated water evaporates, thereby reducing piercing pressure buildup and mitigating piercing damage to the workpiece. In such embodiments, use of abrasives that are not wettable and/or an abrasive supply conduit that repels or at least partially repels water may reduce or eliminate the need for vacuum assist devices and/or water flushing devices to remove wet abrasives. In such embodiments, an abrasive that may not lose its hydrophobicity when exposed to very high temperatures (e.g., water at or above approximately 100 degrees Celsius, such as 250 degrees Celsius) can be utilized.

Figure 5A:
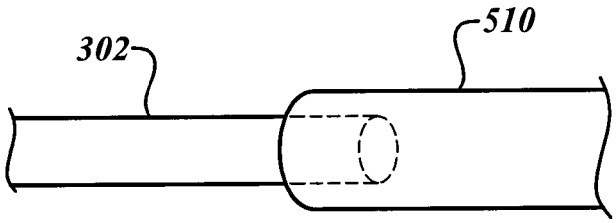
FIGS. 5A-5C are enlarged side views of a portion of an abrasive supply conduit.
Figure 5B:
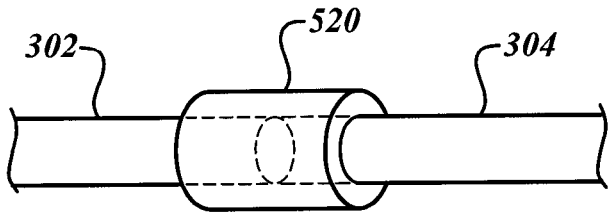
Figure 5C:
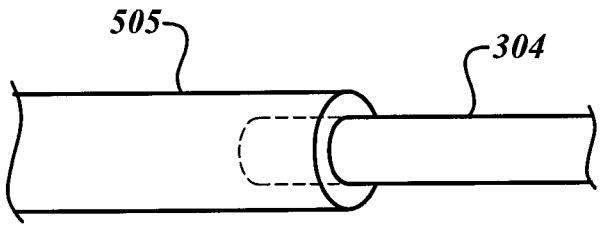

FIGS. 5A-5C are a series of enlarged side isometric views illustrating couplings between a first conduit portion and a second conduit portion of the abrasive supply conduit 220. In FIG. 5A, the first conduit portion 302 has an outside diameter that is equal to or slightly smaller than an inside diameter of a second conduit portion 510. In FIG. 5B, the first conduit portion 302 and the second conduit portion 304 have generally the same outside diameter and are joined by a larger diameter coupling portion 520 that forms a sleeve type joint. FIG. 5C illustrates a first conduit portion 505 having an inside diameter that is equal to or slightly larger than an outside diameter of the second conduit portion 304. Those of skill in the art will understand that various other ways of coupling the first and second portions of the abrasive supply conduit may be used.

Figure 6:
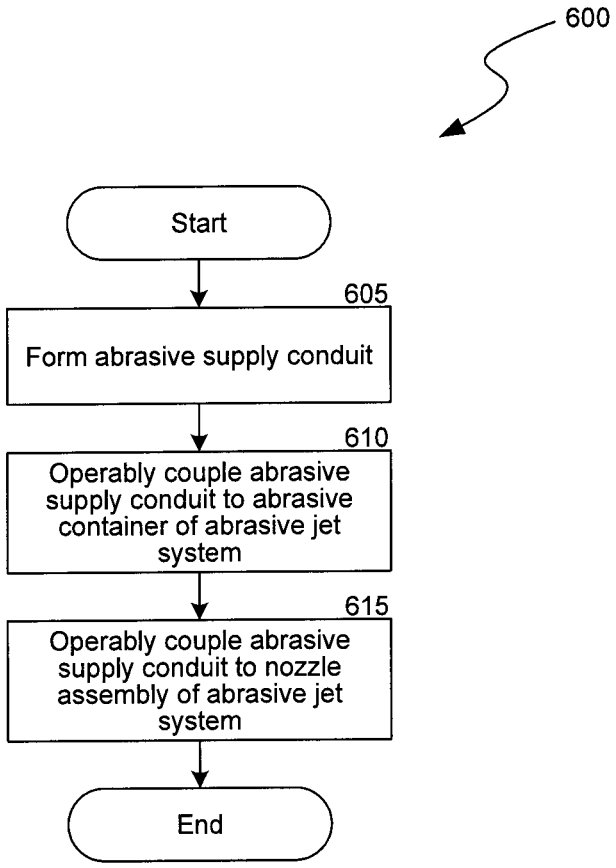
FIG. 6 is a flow diagram of a process for assembling an abrasive jet system in accordance with an embodiment of the disclosure.

FIG. 6 is a flow diagram of a process 600 for assembling an abrasive jet system in accordance with an embodiment of the disclosure. The process 600 begins at step 605, where an abrasive supply conduit is formed. The abrasive supply conduit can be formed by operably coupling a first conduit portion to a second conduit portion as described above. The first conduit portion includes a hydrophobic interior surface portion, and the second conduit portion includes a non-hydrophobic interior surface portion. At step 610, the abrasive supply conduit is operably coupled to an abrasive container. At step 615, the abrasive supply conduit is operably coupled to an abrasive inlet port of an abrasive jet nozzle assembly, such that the first conduit portion is positioned proximate to the abrasive inlet port. The process 600 then concludes.

Figure 7:
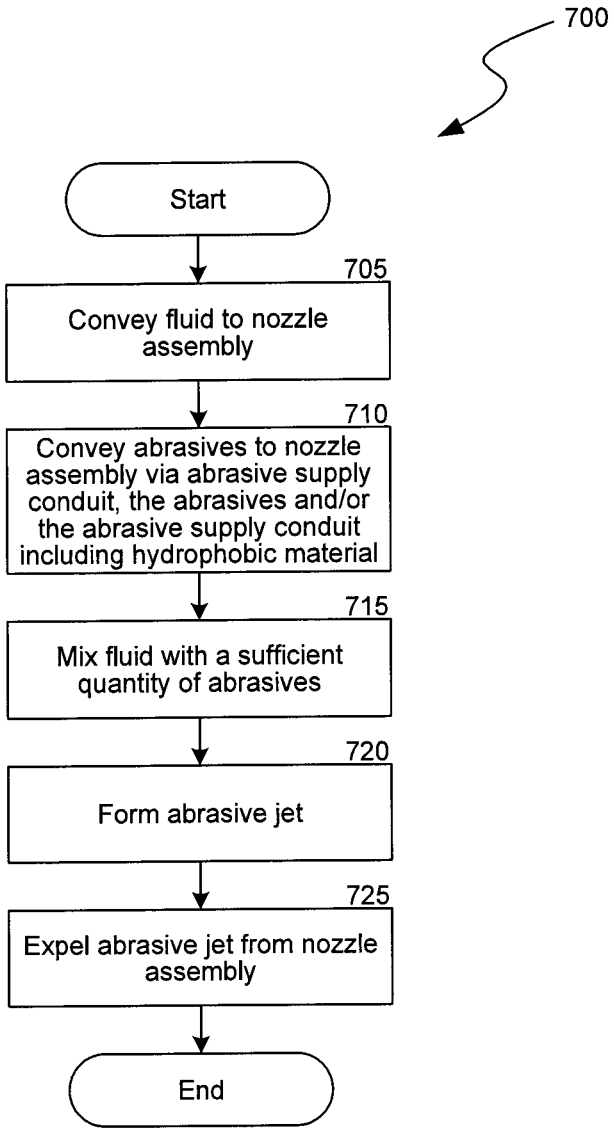
FIG. 7 is a flow diagram of a process for operating an abrasive jet system in accordance with an embodiment of the disclosure.

FIG. 7 is a flow diagram of a process 700 for operating an abrasive jet system in accordance with an embodiment of the disclosure. The process 700 begins at step 705, where water is conveyed from a water source of an abrasive jet system to a nozzle assembly of the abrasive jet system. At step 710, abrasives are conveyed from an abrasive source of the abrasive jet system to the nozzle assembly via an abrasive supply conduit. At least one of the abrasives and the abrasive supply conduit includes at least generally hydrophobic material. At step 715, a fluid is mixed with a quantity of the abrasives sufficient to process a workpiece according to a desired quality. At step 720, an abrasive jet of the fluid and the abrasives is formed. At step 725, the abrasive jet is expelled from an opening of the nozzle assembly. In some embodiments, an abrasive jet system operating in accordance with the process 700 does not remove abrasives using vacuum assist and/or flushing devices. In such embodiments, the abrasive jet system does not remove abrasives from the nozzle assembly other than through the nozzle assembly opening while the expelling is ongoing.

Those skilled in the art will appreciate that the steps shown in any of FIGS. 6 and 7 may be altered in a variety of ways. For example, the order of the steps may be rearranged; substeps may be performed in parallel; shown steps may be omitted, or other steps may be included; etc.

One of the challenges of abrasive jets or waterjets is their tendency to induce damage during piercing delicate materials. Certain materials, such as composite materials and brittle materials, may be difficult to pierce with an abrasive jet. For example, an abrasive jet directed at a workpiece composed of such material strikes a surface of the workpiece and begins forming a cavity or blind hole in the surface. As the cavity forms, a hydrostatic pressure may build within the cavity resulting from conversion of the kinetic energy of high-speed water droplets into the potential energy. This hydrostatic pressure may act upon sidewalls of the cavity and may thereby negatively impact the workpiece material. For example, in the case of composite materials such as laminates, this hydrostatic pressure may cause composite layers to separate or delaminate from one another as the hydrostatic pressure exceeds the tensile strength of the weakest component of the materials, which is typically the composite binder. In the case of brittle materials such as glass, polymers, and ceramics, the hydrostatic pressure may cause the material to crack or fracture if the hydrostatic pressure acts upon intergranular cracks or micro fissures in the material. Other aspects or effects of the abrasive jet other than the hydrostatic pressure may, in addition or as an alternative to the hydrostatic pressure, cause damage to the material during abrasive jet piercing operations.

Conventional techniques used to mitigate piercing damage to materials include pressure ramping and vacuum assist devices. Pressure ramping can involve using a reduced water pressure to form the waterjet in an attempt to ensure that abrasives are fully entrained in the waterjet before a hydrostatic pressure induced by fluid water alone reaches a magnitude capable of causing damage to the material being pierced. A vacuum assist device can also be used to draw abrasive into a mixing chamber of a waterjet cutting head prior to the arrival of water into the mixing chamber. Such a technique attempts to ensure that a water-only jet does not strike the surface of the material. Other piercing damage mitigation techniques include superheating high pressure water downstream of the pump and upstream of the nozzle such that the pressurized high-temperature water remains in the liquid state upstream of the inlet orifice in the nozzle and then evaporates upon exiting the nozzle, as disclosed in U.S. Pat. No. 7,815,490, which is incorporated herein by reference in its entirety. As a result, only high-speed abrasives and very little liquid water enters the cavity or blind hole in the delicate material. Therefore, the hydrostatic pressure buildup inside the cavity is minimized leading to the mitigation of piercing damage to delicate materials. Yet another piercing damage mitigation technique involves pressurized abrasive feeding to degrade the abrasive jet in a controlled manner, as disclosed in U.S. Provisional Patent Application No. 61/390,946, entitled "SYSTEMS AND METHODS FOR ALTERING AN ABRASIVE JET FOR PIERCING OF DELICATE MATERIALS," filed Oct. 7, 2010, and incorporated by reference herein in its entirety. The degradation of the abrasive jet would reduce the magnitude of the hydrostatic pressure inside the cavity while the pressurized abrasive feeding would ensure abrasives reach the workpiece simultaneously with the waterjet.

The above remedies, however, require additional hardware to implement. In contrast, systems and methods configured in accordance with additional embodiments of the disclosure can take advantage of the non-wetting and non-clogging properties of hydrophobic abrasives to reduce or otherwise mitigate piercing or other damage to delicate materials, such as composites, laminates, and brittle materials. For example, by intentionally leaving at least some abrasives inside the nozzle before the jet is turned on and/or after the jet is turned off, these abrasives in the nozzle will be delivered to the workpiece as soon as the jet is turned on. Delivering these abrasives in the initial impact or contact of the jet can at least partially avoid or reduce piecing damage to the workpiece. For example, piercing damage is usually induced when the jet is void of abrasives such that a large hydrostatic pressure is developed inside a blind hole in the workpiece. A workpiece with a tensile strength lower than the induced hydrostatic pressure would likely be damaged by cracking, chipping, and delamination. Accordingly, systems and methods configured in accordance with the present disclosure can profit from the non-wetting and non-clogging properties of hydrophobic abrasives by setting a delay time to deliver the fluid or the abrasives (e.g., before the jet is turned on and after the jet is turned off) to reduce the piercing damage on delicate materials, such as G10 for example. More specifically, in one embodiment, the delivery of the fluid to the nozzle can be delayed until after conveying a sufficient quantity of abrasives in the nozzle. In other embodiments, the abrasives can continue to be conveyed to the nozzle after terminating the delivery of the fluid to the nozzle. Accordingly, the delay time would enable some abrasives to remain in the mixing region or chamber and/or the feed tube (e.g., near the nozzle end) so that the abrasives will be present in the jet as soon as the jet is turned on. As a result, abrasives reach the workpiece simultaneously with the waterjet. An additional advantage of such a process is that there is no added hardware to the jet system. Rather, the delay time can be set or programmed in the system as appropriate. Moreover, for delicate materials with extremely low tensile strength and for very brittle materials, embodiments of the present disclosure can further include gradually increasing or ramping up the jet pressure gradually via software control to further minimize piercing damage.

From the foregoing, it will be appreciated that specific embodiments have been described herein for purposes of illustration, but that various modifications may be made without deviating from the spirit and scope of the present disclosure. Those skilled in the art will recognize that numerous liquids other than water can be used with embodiments disclosed herein, and the recitation of a jet as comprising water should not necessarily be interpreted as a limitation. For example, fluids other than water can also be employed to cut materials that cannot be in contact with water. The customary term for the process of cutting with a fluid is "water-jet cutting" and the like, but the term "water-jet cutting" is not intended to exclude cutting by abrasive jets of fluid other than water. If a fluid other than water is utilized in an abrasive jet system, the first interior surface portion 305 (FIG. 3) may include materials that prevent the fluid from adhering to the first interior surface portion 305 or otherwise repel the fluid. As another example, portions of the nozzle assembly, such as the walls that define the mixing cavity and/or portions of the mixing tube, may include hydrophobic materials, superhydrophobic materials, and/or other materials configured to repel the fluid used in the abrasive jet system or otherwise prevent the fluid from adhering to the walls. Further, while advantages associated with certain embodiments have been described in the context of those embodiments, other embodiments may also exhibit such advantages, and not all embodiments need necessarily exhibit such advantages to fall within the scope of the present disclosure. Accordingly, the inventions are not limited except as by the appended claims.

I claim:

1. An abrasive jet system comprising:

an abrasive container;

a nozzle assembly having a mixing cavity downstream of a fluid inlet aperture and proximate to an abrasive inlet port, wherein the fluid inlet aperture is configured to receive a fluid; and an abrasive supply conduit operably coupleable between the abrasive container and the abrasive inlet port, the abrasive supply conduit including a first interior surface portion configured to be positioned proximate to the abrasive inlet port and a second interior surface portion, different from the first interior surface portion, configured to be spaced apart from the abrasive inlet port, wherein the first interior surface portion is configured to repel a portion of the fluid upon splash back of the portion of the fluid into the supply conduit from the mixing assembly, and wherein the first interior surface portion has a different ability to repel the portion of the fluid than the second interior surface portion.

2. The abrasive jet system of claim 1 wherein the first interior surface portion has a greater ability to repel the fluid than the second interior surface portion.

3. The abrasive jet system of claim 1, further comprising abrasives contained within the abrasive container, wherein the abrasives remain dry upon exposure to the fluid.

4. The abrasive jet system of claim 1 wherein the abrasive supply conduit includes a first conduit portion that includes the first interior surface portion and a second conduit portion that includes the second interior surface portion, wherein the first and second conduit portions are operably coupleable together between the abrasive container and the abrasive inlet port.

5. The abrasive jet system of claim 1 wherein the first interior surface portion includes polytetrafluoroethylene.

6. The abrasive jet system of claim 1 wherein the abrasive inlet port extends through an external surface of the nozzle assembly and wherein the abrasive inlet port has a less than or equal to 90 degree orientation to the external surface.

7. The abrasive jet system of claim 1 wherein the nozzle assembly does not include an aperture to which a vacuum assist device can be operably coupled.

8. An abrasive jet system comprising:

a container configured to hold abrasives;

a nozzle assembly including— a mixing region;

a fluid inlet configured to direct a fluid jet into the mixing region;

an abrasive inlet port proximate to the mixing region; and an axial passage downstream of the mixing region; and a conduit having a first end portion operably coupleable to the container and a second end portion operably coupleable to the abrasive inlet port, the conduit including an interior surface, wherein the conduit is configured to direct abrasives from the container into the mixing region via the abrasive inlet port, whereby the abrasives are mixed with the fluid jet in the mixing region, thereby forming an abrasive jet conveyed through the axial passage, and wherein at least a portion of the interior surface is hydrophobic to repel a portion of the fluid upon splash back of the portion of the fluid into the conduit from the mixing region.

9. The abrasive jet system of claim 8 wherein the hydrophobic portion of the interior surface is a first portion of the interior surface, and wherein the interior surface includes a second portion that is non-hydrophobic.

10. The abrasive jet system of claim 8 wherein the entire interior surface of the conduit is hydrophobic.

11. The abrasive jet system of claim 8, further comprising hydrophobic abrasives positioned within the container.

12. The abrasive jet system of claim 8 wherein the first hydrophobic surface portion includes polytetrafluoroethylene.

13. The abrasive jet system of claim 8 wherein the hydrophobic portion of the interior surface is hydrophobic to an at least partially aqueous fluid.

14. The abrasive jet system of claim 8 wherein the hydrophobic portion of the interior surface is hydrophobic to a non-aqueous solution.

15. An abrasive jet system comprising:

means for holding abrasives;

means for forming an abrasive fluid jet, the means for forming including a fluid inlet aperture and an abrasive inlet aperture, wherein the fluid inlet aperture conveys fluid to a mixing cavity;

means for conveying abrasives from the means for holding to the abrasive inlet aperture, wherein the means for conveying includes a first interior surface portion configured to be proximate to the abrasive inlet aperture and a second interior surface portion configured to be spaced apart from the abrasive inlet aperture, wherein a portion of the fluid from the mixing cavity splashes onto the first interior surface; and means for returning the portion of the fluid that splashed onto the first surface into the mixing cavity, wherein the means for returning the portion of the fluid is configured to prevent abrasives in the portion of the fluid from adhering to at least one of the first and second interior surface portions.

16. The abrasive jet system of claim 15, further comprising means for repelling fluid with the abrasives.

17. The abrasive jet system of claim 15 wherein the means for preventing fluid includes polytetrafluoroethylene.

18. A method of manufacturing an abrasive jet system, the method comprising:

coupling a first tube portion to a second tube portion to form a supply conduit, wherein the first tube portion includes a hydrophobic interior surface region and the second tube portion includes a non-hydrophobic interior surface region;

coupling the second tube portion of the abrasive supply conduit to an abrasive source; and coupling the first tube portion of the abrasive supply conduit to an abrasive inlet port proximate to a mixing region of the nozzle assembly, wherein the nozzle assembly includes a fluid inlet aperture configured to direct a jet of fluid into the mixing region, wherein coupling the first tube portion to the abrasive inlet port includes— positioning the hydrophobic surface proximate to the mixing region to receive a splash back of fluid from the mixing region; and positioning the first tube portion such that the splash back of fluid returns to the mixing region.

19. An abrasive jet system comprising:

a nozzle assembly having a mixing cavity downstream of a fluid inlet aperture and an abrasive inlet aperture proximate to the mixing cavity, wherein the fluid inlet aperture is configured to direct a jet of fluid into the mixing cavity;

an abrasive container containing abrasives, wherein the abrasives are not wettable by the fluid; and an abrasive supply conduit operably coupleable between the abrasive container and the abrasive inlet aperture, wherein the abrasive supply conduit is configured to repel a portion of the fluid upon splash back of the portion of the fluid into the abrasive supply conduit from the mixing cavity.

20. The abrasive jet system of claim 19 wherein at least some of the abrasives include an external surface that is not wettable by the fluid.

21. The abrasive jet system of claim 19 wherein at least some of the abrasives include at least one of hydrophobic material and superhydrophobic material.

22. The abrasive jet system of claim 19 wherein the abrasive supply conduit includes a first interior surface portion configured to be positioned proximate to the abrasive inlet aperture and a second interior surface portion, different from the first interior surface portion, configured to be spaced apart from the abrasive inlet aperture, wherein the first interior surface portion has a greater ability to repel the fluid than the second interior surface portion.

23. The abrasive jet system of claim 19 wherein the abrasives remain dry upon exposure to fluid having a temperature of up to about 100 degrees Celsius.

24. An abrasive jet system comprising:

means for forming an abrasive fluid jet, the means for forming including a fluid inlet aperture configured to receive a fluid and an abrasive inlet aperture;

means for holding;

means for abrading positioned within the means for holding, wherein the means for abrading remains dry when mixed with the fluid; and means for conveying the means for abrading from the means for holding to the abrasive inlet aperture, means for returning at least a portion of the fluid to the means for forming an abrasive fluid jet when the means for forming an abrasive fluid jet splashes the portion of the fluid into the means for conveying the means for abrading.

25. The abrasive jet system of claim 24, wherein the means for conveying includes a first interior surface portion configured to be proximate to the abrasive inlet aperture and a second interior surface portion configured to be spaced apart from the abrasive inlet aperture, and wherein the abrasive jet system further comprises:

means for preventing the fluid from adhering to the first interior surface portion; and means for allowing the fluid to adhere to the second interior surface portion.

26. A method of operating an abrasive jet system, the method comprising:

conveying fluid from a fluid source to a mixing cavity of a nozzle assembly of the abrasive jet system;

conveying abrasives from an abrasive source to the mixing cavity of the nozzle assembly via an abrasive supply conduit, wherein at least one of the abrasives and the abrasive supply conduit includes at least generally hydrophobic material;

mixing with the fluid a quantity of abrasives to form an abrasive jet;

expelling the abrasive jet from an opening in the nozzle assembly; and returning at least a portion of the fluid to the mixing cavity upon splash back of the portion of the fluid into the abrasive supply conduit from the mixing cavity.

27. The method of claim 26 wherein abrasives are not removed from the nozzle assembly other than through the opening while the expelling is ongoing.

28. The method of claim 26 wherein:

conveying fluid from the fluid source to the nozzle assembly comprises conveying fluid to a mixing region of the nozzle assembly; and conveying abrasives from the abrasive source to the nozzle assembly comprises conveying abrasives to the mixing region of the nozzle assembly before conveying fluid to the mixing region.

29. The method of claim 26, further comprising continuing to convey abrasives to the nozzle assembly after stopping conveying fluid to the nozzle assembly.

* * * * *

UNITED STATES PATENT AND TRADEMARK OFFICE

CERTIFICATE OF CORRECTION

PATENT NO. : 8,920,213 B2
APPLICATION NO. : 13/038779
DATED : December 30, 2014
INVENTOR(S) : Peter H.-T. Liu It is certified that error appears in the above-identified patent and that said Letters Patent is hereby corrected as shown below:

On the Title page, after the Cross-Reference to Related Applications paragraph, in column 1, at line 19, insert the paragraph below:

-- ACKNOWLEDGEMENT OF GOVERNMENT SUPPORT

This invention was made with government support under National Science Foundation Grant No. 1058278. The Government has certain rights in this invention. --

Signed and Sealed this
Seventeenth Day of May, 2016

Michelle K. Lee

Michelle K. Lee
*Director of the United States Patent and Trademark Office*